US005336067A

United States Patent [19]

Lim

[11] Patent Number: 5,336,067

[45] Date of Patent: Aug. 9, 1994

[54] SPHERICAL ENGINE

[76] Inventor: Leon Lim, 29 Red Oak Drive, Richmond Hill, Ontario, Canada, L4B 1V5

[21] Appl. No.: 72,306

[22] Filed: Jun. 9, 1993

[51] Int. Cl.[5] ..... F04C 2/00

[52] U.S. Cl. ..... 418/49; 123/241

[58] Field of Search ..... 418/49, 51, 50, 68; 123/241

[56] References Cited

U.S. PATENT DOCUMENTS

| | | | |
|---|---|---|---|
| 2,496,668 | 2/1950 | Manseau | 418/49 |
| 3,464,361 | 9/1969 | Voser . | |
| 3,492,974 | 2/1970 | Kreimeyer | 123/8 |
| 3,895,610 | 7/1975 | Wahl | 123/8.45 |
| 4,877,379 | 10/1989 | Okabe | 418/51 |

FOREIGN PATENT DOCUMENTS

| | | | |
|---|---|---|---|
| 2514945 | 10/1976 | Fed. Rep. of Germany | 418/51 |

*Primary Examiner*—Richard A. Bertsch
*Assistant Examiner*—Charles G. Freay
*Attorney, Agent, or Firm*—Kenneth M. Garrett

[57] ABSTRACT

In a nutating spherical engine, improvements for increasing the seal between the rotor and the engine head comprise the provisions of a pair of minor cusps disposed on the rotor which as seen in plan view are diametrically opposed and at right angles to the major cusps of the rotor. The engine may include a rotor guide including a cam and cam follower which cause the rotor to undergo the same nutational rotation as that caused by the interaction of the rotor and cylinder head. The rotor and cylinder head may be coupled by a ball and socket, and the ball may contain a simple coupling for the drive shaft of the engine. The cam, cam follower and coupling of the engine are easily located as they are not in direct communication with the working chambers of the engine.

21 Claims, 5 Drawing Sheets

SPHERICAL ENGINE

FIELD OF INVENTION

This invention relates to improvements to nutating engines.

BACKGROUND OF INVENTION

Nutating engines are well known in the patent literature, and are well described in the following patents:

U.S. Pat. No. 3,492,974 to Kreineyer

U.S. Pat. No. 4,877,379 to Okabe.

As used herein the word engine is used in its broadest sense to define a mechanism which may be used as a pump for pumping fluids including compressible and noncompressible fluids and as an internal or external combustion engine, for example.

Although nutating engines have excited considerable interest, this has been largely confined to paper proposals, in part due to difficulties in machining the relatively complex surfaces, and also in part due to wear problems, sealing problems and gearing problems. The first two problems are somewhat interrelated. In the engines of the prior art, the nutating action of the rotor arises from the face to face contact of confronting, relatively rotating surfaces, which define between them the variable volume pockets of the engine within which, for example, a gas may be compressed or expanded. Difficulty is often experienced in lubricating these confronting surfaces, and wear may be relatively high on the rubbing portions of the surfaces, leading to rapid wear and a loss of seal between adjacent pockets.

Typically in a nutating engine one of the relatively rotating surfaces has three cavities alternating with three sharply defined cusps, and the other surface has two rounded, diametrically opposed cusps alternating with two shallow cavities. In such engine, when the parts are relatively rotated so that the rotor defining one of the pockets is in a position which, in an equivalent piston engine would be referred to as bottom dead centre, the rotor will at the same time define an adjacent pocket which would be equivalent to that where a piston would be at top dead centre in a piston engine. In this relative position of the rotory engine, the pressure in the one pocket is at a minimum while the pressure is an adjacent pocket is at a maximum. The seal between these two pockets comprises a sharply defined cusp which contacts a shallow cavity adjacent to its maximum radius of curvature, whereby the area of contact and interfering proximity between the adjacent confronting surfaces is at a minimum.

SUMMARY OF THE INVENTION

In accordance with one aspect of the invention, I provide in a nutating engine in the relatively rotating part on which the two rounded cusps are disposed, a second pair of cusps which, as seen in plan view, are diametrically opposed and at right angles to the first described pair. The second pair of cusps are minor in comparison to the first pair. The minor cusps disposed in this manner create a zone of minimum radius against which a seal is made when the pressure differential between adjacent pockets is at a maximum, as described above, thereby increasing the area of contact and interfering proximity between the relatively rotating parts when in this relative position.

In accordance with another aspect of my invention, I provide in a nutating engine a rotor guide, the rotor and rotor guide together having a cam and cam follower action which, as the rotor rotates, causes the rotor to undergo a nutating action to mimic that arising from the interaction of the cusps and cavities. Accordingly, it is not required that there be any surface contact between the confronting surfaces of the engine in order to induce the nutating action of the engine. The degree of contact and close interference between the confronting faces may therefore be adjusted to suit the purpose for which the engine is to be used, generally resulting in a greatly reduced wear between the confronting surfaces. The cam and cam follower are completely isolated from the pockets of the engine and are easily lubricated, whereby the wear between them is limited.

In accordance with yet another aspect of my invention, the confronting surfaces are provided with a ball and socket joint concentred with the notional centre of origin of the spherical chamber of the engine, and the member on which the rounded major pair of diametrically opposed cusps are disposed forms the rotor. The drive shaft is coupled to the ball and socket joint by a simple swivel mechanism which permits the rotor to rock in a plane containing the drive shaft and the diameter on which the cusps are disposed, but which otherwise constrains relative movement between the rotor and the drive shaft. Suitably, the ball is disposed on the rotor and is provided with a flat sided, rounded bottom slot; the drive shaft is provided with a rounded, flat sided end which is received in the slot to permit the desired rocking action. This swivel mechanism is completely sealed from the pockets of the engine and is easily lubricated so as to reduce wear.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
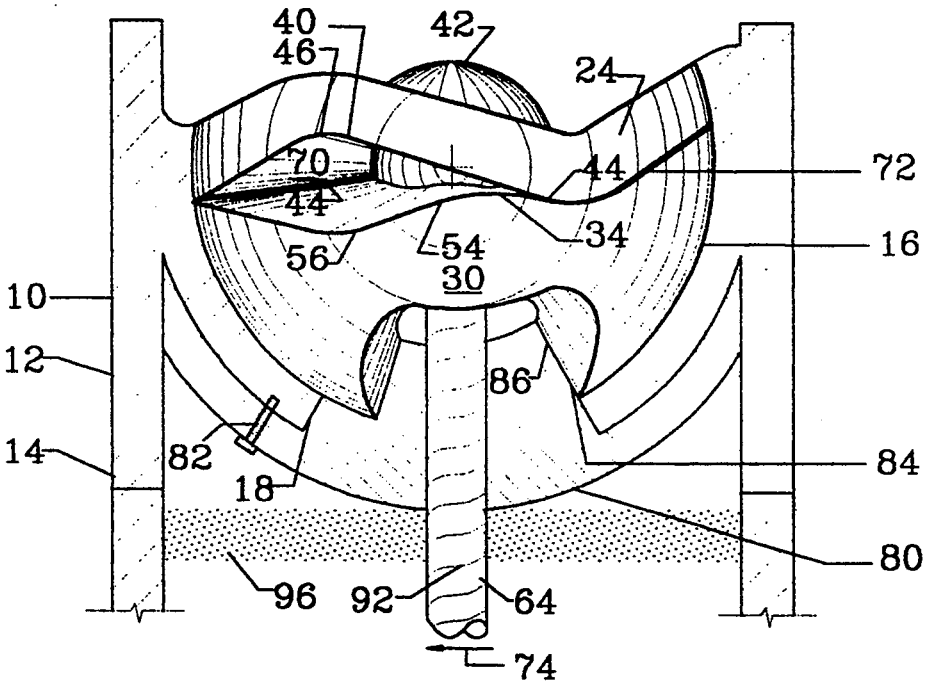
FIG. 1 is a composite view of an engine in accordance with the invention showing the casing in vertical mid-cross section and the rotor and head portions in side elevation.
Figure 4:
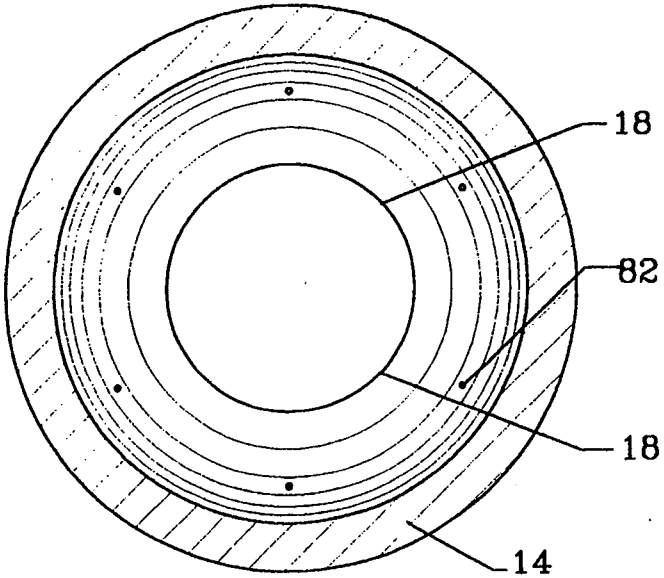
FIG. 4 is a view of the spherical bearing surface of the chamber as seen in 4—4 of FIG. 2.
Figure 3:
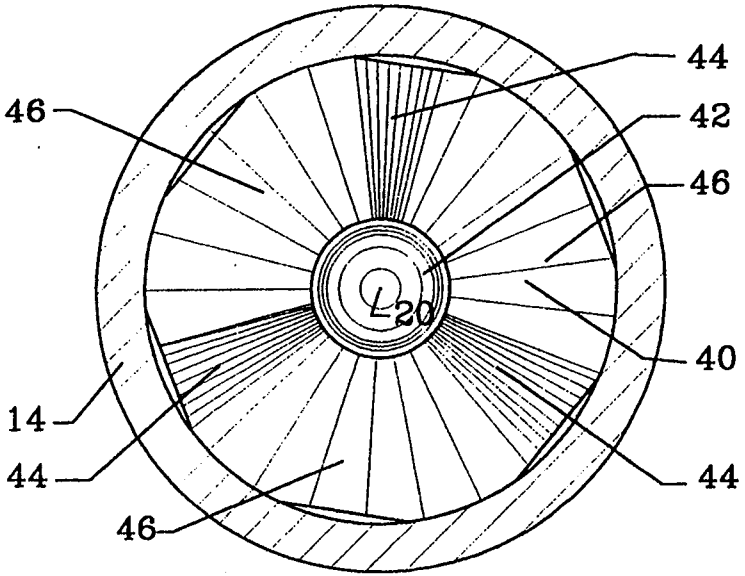
FIG. 3 is a view of the lower, confronting surface of the head as seen in 3—3 of FIG. 2.
Figure 2:
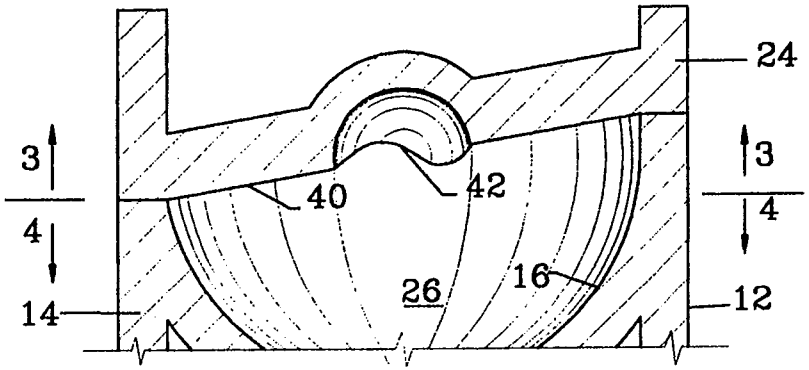
FIG. 2 is a vertical mid-cross section of the upper portions of the engine of FIG. 1, with the rotor removed.
Figure 5:
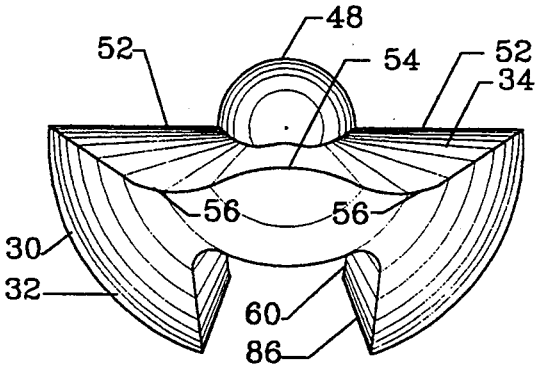
FIG. 5 is a side elevation of the rotor of the engine of FIG. 1.
Figure 6:
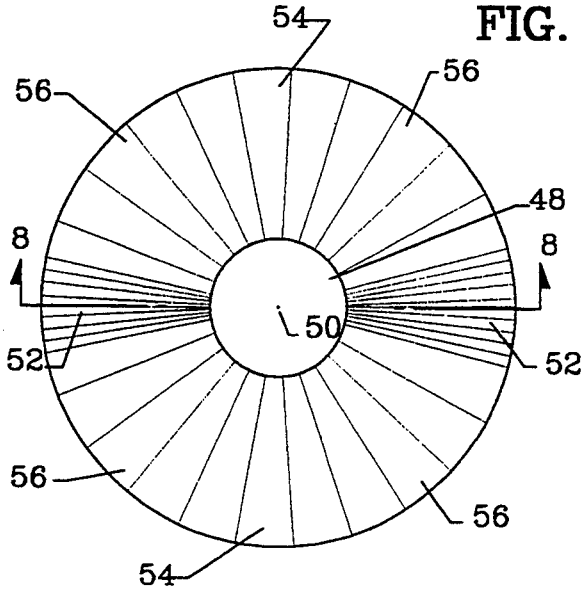
FIG. 6 is a plan view from above of the rotor of FIG. 5.
Figure 7:
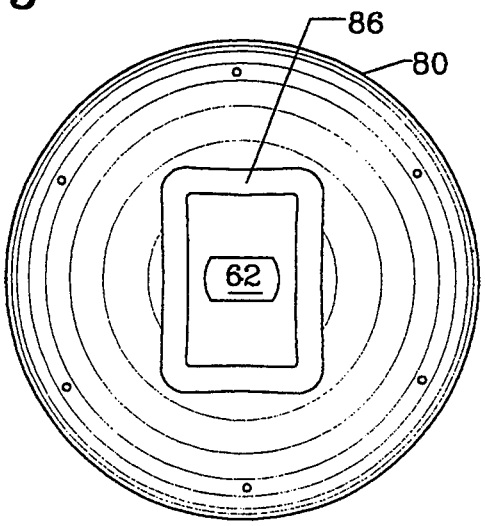
FIG. 7 is a plan view from below of the rotor of FIG. 5.
Figure 8:
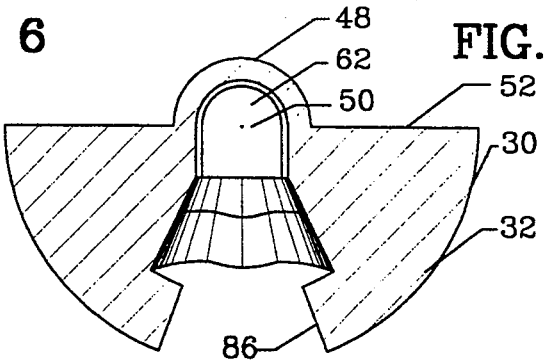
FIG. 8 is a cross section of the rotor of FIG. 5, seen on line 8—8 of FIG. 6.
Figure 9:
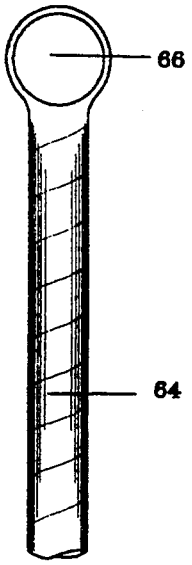
FIG. 9 is a side elevation of the drive shaft used with the rotor of FIG. 5.
Figure 10:
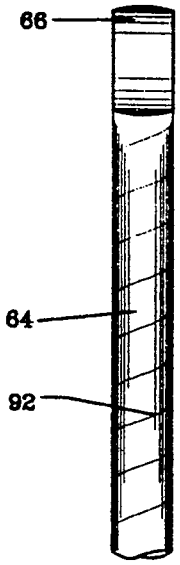
FIG. 10 is similar to FIG. 9, but rotated through 90° about the axis of the rotor.
Figure 11:
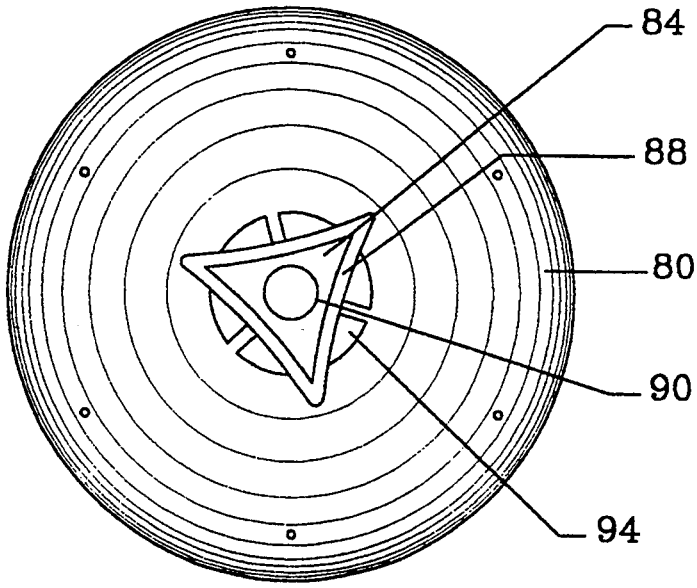
FIG. 11 is a plan view from above of the rotor guide of the engine of FIG. 1.
Figure 12:
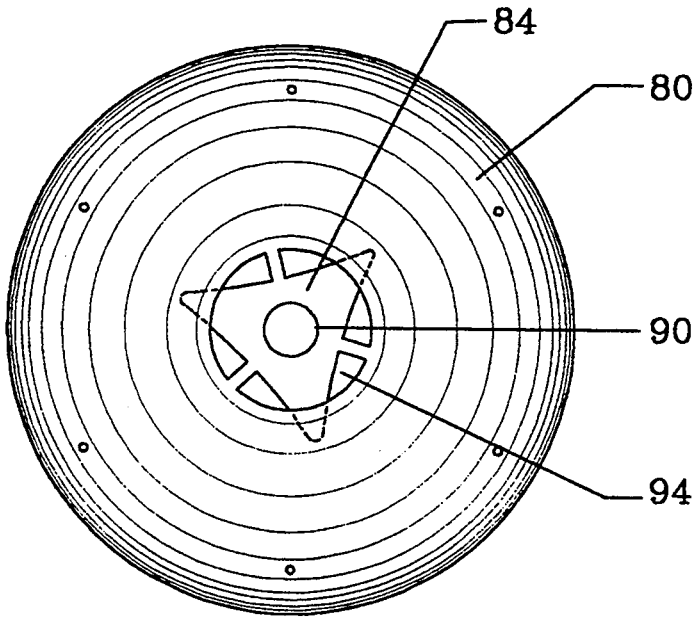
FIG. 12 is a plan view from below of the rotor guide of FIG. 11.

Referring to the drawings in detail, the nutating engine of the invention is identified generally therein by the numeral 10. As is well known in the art, this type of engine may be used as an internal or external combustion engine or as a pump, and auxiliary parts that may be used therefor such as valves and ignition plugs are well known and are omitted from the drawings and the ensuing description for the sake of clarity.

Engine 10 includes a casing 12 having a side wall 14 which is generally circular in horizontal cross-section, and a spherical bearing surface 16 having a central opening 18 therethrough. Bearing surface 16 has a notional centre of origin 20.

Engine 10 further includes a head 24 which is secured to casing 12 to define therewith a chamber 26.

Within chamber 26 there is disposed a rotor 30. Rotor 30 has a spherically formed seat 32 complementary to the bearing surface 16, and an upper surface 34. The surface of head 24 confronting upper surface 34 of rotor 30 is identified by the number 40.

Confronting surface 40 has a spherical socket 42 concentred on the centre of origin 20, and surrounding the socket, the surface 40 is defined by the locus of points on a radial line originating at the centre of origin 20 which is rotated about an angle of 360° while undergoing a wave like motion to define three relatively sharp cusps 44 alternating with three rounded cavities 46. The upper, confronting surface 34 of rotor 30 has a ball 48 raised centrally thereon complementary to socket 42, the ball having a centre 50. Surrounding the ball 48, the surface 34 is defined by the locus of points on a line centred on centre 50 which is rotated about an angle of 360° while undergoing a wave like motion to define a first pair of diametrically opposed major cusps 52 and a second pair of diametrically opposed minor cusps 54 at right angles to the first pair as seen in plan view, cusps 52 and 54 alternating with four rounded cavities 56. Cusps 52 and 54 are gently rounded, in comparison to cusps 44 and cusps 54 have a height above cavities 56 which is somewhat less than that of cusps 52.

Rotor 30 has a central opening 60 in seat 32, the shape and purpose of which will be subsequently described. Opening 60 connects to a flat sided slot 62 formed in the interior of ball 48 in alignment with major cusps 52. The upper blind end of slot 62 is formed on a radius centred on ball centre 50. When rotor 30 is positioned within chamber 26, ball centre 50 and sphere centre of origin 20 will be coincident.

Engine 10 includes a drive shaft 64 having a flat sided, rounded end 66 which is a snug fit within slot 60 to permit the rotor 30 to rock on the drive shaft end in the plane containing major cusps 52, but to otherwise constrain relative rotational movement between the rotor and drive shaft.

Considering the operation of engine 10 as thus far described, wherein it operates as a compressor and wherein the elements are in the relative rotational position as illustrated in FIG. 1, parts of two pockets 70, 72 are seen. In this operation, the drive shaft 64 is considered to rotate in a clockwise direction, shown by arrow 74. In comparison with a piston compressor, the components defining pocket 70 would be at bottom dead centre, and moving towards compression of the gas contained within the pocket, while the components defining pocket 72 would be at top dead centre, and moving to an exhaust stroke. Accordingly, the volume of gas contained within pocket 72 will be at its minimum pressure while the volume of gas contained within pocket 70 will be at its maximum pressure. Put another way, the pressure differential between pockets 70 and 72 will be at about the maximum for the operation of engine 10, and as a corollary, the tendency for the escape of gas from pocket 70 to pocket 72 will be at a maximum.

The provision of the minor cusps 54 acts to enhance the seal between adjacent pockets when the rotor 30 is in a position in which a cusp 44 locates along the line of intersection of a minor cusp 54 with a cavity 56. In comparison, the seal that is obtained by prior art nutating engines wherein the minor cusps are absent tends to be at a minimum in this position of the rotor, and accordingly it may be seen that the minor cusps act to decrease the leakage between adjacent pockets. It will be appreciated that this is true irrespective of whether engine 10 operates as a compressor or an internal or external combustion engine.

As shaft 64 is rotated, rotor 30 will rotate together with the shaft, and simultaneously it will rock about the lollipop end 66 of the shaft as the confronting surface 34 of the rotor rides over the cusps 44 of head 24. Traditionally, cusps 44 are provided with wear bars (not shown) to decrease the rate of wear.

Engine 10 further comprises a rotor guide 80 secured to the underside of bearing surface 16 by bolts 82. Rotor guide 80 includes a cam 84 which projects upwardly through central opening 18 of the bearing surface 16. As previously mentioned, rotor 30 is provided with a central opening 60 therein, which forms a cam follower 86. Conveniently the rotor guide 80 forms a bearing 90 for drive shaft 64 to reduce the unsupported length of the shaft. Cam 84 has three lobes 88 and cam follower 86 is shaped so that as drive shaft 64 rotates, rotor 30 will undergo the same type of nutational action of the rotor in chamber 26 as it would be caused to undergo by the interaction of confronting surfaces 34 and 40. It will be appreciated that the action of the cam 84 and cam follower 86 makes it no longer necessary that there be any contact between the confronting surfaces 34 and 40 of the rotor 30 and head 24. Accordingly, the clearance between the head and rotor may be adjusted to suit the duty of engine 10, and the wear between the head and rotor may be substantially diminished. The cam 84 and cam follower 86 are conveniently lubricated by means of an oil bath 96 and a spiral channel 92 formed in the surface of drive shaft 64 to pump the oil, this serving also to lubricate the bearing surface 16 and the rocking bearing at shaft end 66. A return path for oil is provided by openings 94 passing through rotor guide 80.

It will be apparent that many changes may be made to the illustrative embodiment while falling within the scope of the invention, and it is intended that all such changes be covered by the claims appended hereto.

I claim:

1. A nutating engine comprising:

a casing having a concave bearing surface forming part of a sphere having a notional centre;

a head defining with said concave bearing surface a chamber;

a rotor contained within said chamber;

said rotor having a spherical seat complementary to said bearing surface and an upper surface, said upper surface and said head forming mutually confronting surfaces each of which has a plurality of cusps alternating with rounded cavities, together forming a plurality of pockets therebetween, the volume of which changes as said rotor undergoes nutational rotation with respect to said head, a drive shaft connect to said rotor for rotation therewith;

said cusps disposed on said rotor including a first, generally aligned pair respectively locating on opposite sides of said notional centre, and a second pair of minor cusps disposed on said confronting surface thereof at right angles to said first pair of cusps as seen in plan view, said second pair of cusps having a lesser height above rounded cavities associated with said rotor than said first pair of cusps; and a rocking mechanism coupling said drive shaft to said rotor to permit said rotor to rock in a plane containing said first pair of cusps and to constrain relative rotational movement between said rotor and said drive shaft in other planes.

2. The nutating engine of claim 1, wherein a rotor guide is secured to said casing on the underside of said rotor, said rotor guide and said rotor together having a cam and a cam follower arranged to mimic the nutating action of said rotor in said chamber, and means for introducing a lubricating oil onto said cam and cam follower surfaces.

3. The nutating engine of claim 2, wherein said cam follower is disposed on the underside of said rotor.

4. The nutating engine of claim 2, wherein said cam has a number of lobes equal to the number of cusps disposed on said confronting surface of said head.

5. The nutating engine of claim 4, wherein the number of lobes is three.

6. The nutating engine of claim 1, wherein said head is provided with a socket centred on said notional centre, and said rotor is provided with a ball received in said socket, and wherein said rocking mechanism is contained within said ball.

7. A nutating engine comprising:

a casing having a concave bearing surface forming part of a sphere having a notional centre;

a head defining with said concave bearing surface a chamber;

a rotor contained within said chamber;

said rotor having a spherical seat complementary to said bearing surface and an upper surface, said upper surface and said head forming mutually confronting surfaces each of which has a plurality of cusps alternating with rounded cavities, together forming a plurality of pockets therebetween, the volume of which changes as said rotor undergoes nutational rotation with respect to said head, a drive shaft connected to said rotor for rotation therewith;

said cusps disposed on said rotor including a first, generally aligned pair respectively locating on opposite sides of said notional centre;

characterized wherein said rotor has a second pair of cusps disposed on said confronting surface thereof at right angles to said first pair of cusps as seen in plan view, said second pair of cusps having a lesser height above said rounded cavities associated with said rotor than said first pair of cusps.

8. The nutating engine of claim 8, wherein said drive shaft is coupled to said rotor by a rocking mechanism to permit said rotor to rock in a plane containing said first pair of cusps and to constrain relative rotational movement between said rotor and said drive shaft in other planes.

9. The nutating engine of claim 7, wherein a rotor guide is secured to said casing on the underside of said rotor, said rotor guide and said rotor together having a cam and a cam follower arranged to mimic the nutating action of said rotor in said chamber, and means for introducing a lubricating oil onto said cam and cam follower surfaces.

10. The nutating engine of claim 9, wherein said cam follower is disposed on the underside of said rotor.

11. The nutating engine of claim 9, wherein said cam has a number of lobes equal to the number of cusps disposed on said confronting surface of said head.

12. The nutating engine of claim 11, wherein the number of lobes is three.

13. The nutating engine of claim 7, wherein said rotor and said head are together provided with a ball and socket centred on said notional centre.

14. A nutating engine comprising:

a casing having a concave bearing surface forming part of a sphere having a notional centre;

a head defining with said concave bearing surface a chamber;

a rotor contained within said chamber;

said rotor having a spherical seat complementary to said bearing surface and an upper surface, said upper surface and said head forming mutually confronting surfaces each of which has a plurality of cusps alternating with rounded cavities, together forming a plurality of pockets therebetween, the volume of which changes as said rotor undergoes nutational rotation with respect to said head, a drive shaft connected to said rotor for rotation therewith;

said cusps disposed on said rotor including a first, generally aligned pair respectively locating on opposite sides of said notional centre, and a second pair of cusps disposed on said confronting surface thereof at right angles to said first pair of cusps, said second pair of cusps having a lesser height above said rounded cavities associated with said rotor than said first pair of cusps; and a rotor guide secured to said casing on the underside of said rotor, said rotor guide and said rotor together having a cam and a cam follower arranged to mimic the nutating action of said rotor in said chamber, and means for introducing a lubricating oil onto said cam and cam follower surfaces.

15. The nutating engine of claim 14, wherein said drive shaft is coupled to said rotor by a rocking mechanism to permit said rotor to rock in a plane containing said first pair of cusps and to constrain relative rotational movement between said rotor and said drive shaft in other planes.

16. The nutating engine of claim 15, wherein said cam follower is disposed on the underside of said rotor.

17. The nutating engine of claim 15, wherein said cam has a number of lobes equal to the number of cusps disposed on said confronting surface of said head.

18. The nutating engine of claim 17, wherein the number of lobes is three.

19. The nutating engine of claim 15, wherein said rotor and said head are together provided with a ball and socket centred on said notional centre, and wherein said rocking mechanism is contained within said ball.

20. A nutating engine comprising:

a casing having a concave bearing surface forming part of a sphere having a notional centre;

a head defining with said concave bearing surface a chamber; said head having a socket centred on said notional centre;

a rotor contained within said chamber;

said rotor having a spherical seat complementary to said bearing surface and an upper surface, and having a ball received in said socket;

said upper surface and said head forming mutually confronting surfaces each of which has a plurality of cusps alternating with rounded cavities, together forming a plurality of pockets therebetween, the volume of which changes as said rotor undergoes nutational rotation with respect to said head;

a drive shaft connected to said rotor for rotation therewith;

said cusps disposed on said rotor including a first, generally aligned pair respectively locating on opposite sides of said notional centre;

a rocking mechanism coupling said drive shaft to said rotor to permit said rotor to rock in a plane containing said first pair of cusps and to constrain relative rotational movement between said rotor and said drive shaft in other planes;

said rocking mechanism being contained within said ball.

21. A nutating engine comprising:

a casing having a concave bearing surface forming part of a sphere having a notional centre;

a head defining with said concave bearing surface a chamber;

a rotor contained within said chamber;

said rotor having a spherical seat complementary to said bearing surface and an upper surface;

said upper surface and said head forming mutually confronting surfaces each of which has a plurality of cusps alternating with rounded cavities, together forming a plurality of pockets therebetween, the volume of which changes as said rotor undergoes nutational rotation with respect to said head;

a drive shaft connected to said rotor for rotation therewith;

said cusps disposed on said rotor including a first, generally aligned pair respectively locating on opposite sides of said notional centre;

a rotor guide secured to said casing on the underside of said rotor, said rotor guide and said rotor together having a cam and a cam follower arranged to mimic the nutating action of said rotor in said chamber, and means for introducing a lubricating oil onto said cam and cam follower surfaces;

said rotor and said head together being provided with a ball and socket centered on said notional center, with a rocking mechanism contained within said ball.

* * * * *